US010028065B2

(12) United States Patent
Goorevich et al.

(10) Patent No.: US 10,028,065 B2
(45) Date of Patent: Jul. 17, 2018

(54) METHODS, SYSTEMS, AND DEVICE FOR REMOTELY-PROCESSING AUDIO SIGNALS

(71) Applicant: Cochlear Limited, Macquarie University (AU)

(72) Inventors: Michael Goorevich, Naremburn (AU); Martin Hillbratt, Lindome (SE)

(73) Assignee: Cochlear Limited, Macquarie University, NSW (AU)

( * ) Notice: Subject to any disclaimer, the term of this patent is extended or adjusted under 35 U.S.C. 154(b) by 85 days.

(21) Appl. No.: 15/165,071

(22) Filed: May 26, 2016

(65) Prior Publication Data

US 2017/0013372 A1 Jan. 12, 2017

Related U.S. Application Data

(60) Provisional application No. 62/189,430, filed on Jul. 7, 2015.

(51) Int. Cl.
*H04R 3/00* (2006.01)
*H04R 25/00* (2006.01)

(52) U.S. Cl.
CPC ..... *H04R 25/554* (2013.01); *H04R 25/407* (2013.01); *H04R 25/552* (2013.01); *H04R 2225/41* (2013.01); *H04R 2225/55* (2013.01); *H04R 2420/05* (2013.01)

(58) Field of Classification Search
CPC .. H04R 25/554; H04R 25/407; H04R 25/552; H04R 2225/41
USPC ..... 381/315
See application file for complete search history.

(56) References Cited

U.S. PATENT DOCUMENTS

2002/0168079 A1* 11/2002 Kuerti ..... H04R 3/002 381/361
2009/0316927 A1* 12/2009 Ferrill ..... H04R 1/02 381/91
2011/0135118 A1* 6/2011 Osborne ..... H04R 1/08 381/122
2014/0194775 A1* 7/2014 Van Hasselt ..... A61B 5/123 600/559
2014/0314261 A1* 10/2014 Selig ..... H04R 25/50 381/314
2015/0382097 A1* 12/2015 strand ..... H04R 1/1091 381/57
2016/0174001 A1* 6/2016 Ungstrup ..... H04R 25/505 381/315
2016/0234612 A1* 8/2016 Solum ..... H04R 25/554
2017/0257711 A1* 9/2017 Wernaers ..... H04R 25/505

* cited by examiner

*Primary Examiner* — Sean H Nguyen

(57) ABSTRACT

Disclosed herein are methods, systems, and devices for remotely-processing one or more audio signals received at a hearing device. An example method includes a hearing device receiving from a media device a command to send to the media device an audio signal. Responsive to at least the command, the method includes the hearing device sending to the media device the audio signal. The method also includes the hearing device receiving from the media device a remotely-processed signal. Data included in the remotely-processed signals is based on audio data included in the audio signal. Based on at least the remotely-processed signal, the method includes the hearing device generating a stimulation signal and using the stimulation signal to deliver at least one stimulus to a recipient of the hearing device.

17 Claims, 10 Drawing Sheets

METHODS, SYSTEMS, AND DEVICE FOR REMOTELY-PROCESSING AUDIO SIGNALS

BACKGROUND

Unless otherwise indicated herein, the information described in this section is not prior art to the claims and is not admitted to be prior art by inclusion in this section.

Various types of hearing devices provide people with different types of hearing loss with the ability to perceive sound. Hearing loss may be conductive, sensorineural, or some combination of both conductive and sensorineural. Conductive hearing loss typically results from a dysfunction in any of the mechanisms that ordinarily conduct sound waves through the outer ear, the eardrum, or the bones of the middle ear. Sensorineural hearing loss typically results from a dysfunction in the inner ear, including the cochlea where sound vibrations are converted into neural signals, or any other part of the ear, auditory nerve, or brain that may process the neural signals.

People with some forms of conductive hearing loss may benefit from hearing devices such as hearing aids or electromechanical hearing devices. A hearing aid, for instance, typically includes at least one small microphone to receive sound, an amplifier to amplify certain portions of the received sound, and a small speaker to transmit the amplified sounds into the recipient's ear. An electromechanical hearing device, on the other hand, typically includes at least one small microphone to receive sound and a mechanism that delivers a mechanical force to a bone (e.g., the recipient's skull, or a middle-ear bone such as the stapes) or to a prosthetic (e.g., a prosthetic stapes implanted in the recipient's middle ear), thereby causing vibrations in cochlear fluid.

Further, people with certain forms of sensorineural hearing loss may benefit from hearing devices such as cochlear implants and/or auditory brainstem implants. Cochlear implants, for example, include at least one microphone to receive sound, a unit to convert the sound to a series of electrical stimulation signals, and an array of electrodes to deliver the stimulation signals to the recipient's cochlea so as to help the recipient perceive sound. Auditory brainstem implants use technology similar to cochlear implants, but instead of applying electrical stimulation to a recipient's cochlea, they apply electrical stimulation directly to a recipient's brain stem, bypassing the cochlea altogether while still helping the recipient perceive sound.

In addition, some people may benefit from hearing devices that combine one or more characteristics of the acoustic hearing aids, vibration-based hearing devices, cochlear implants, and/or auditory brainstem implants to perceive sound.

Hearing devices such as these typically include an external processing unit that typically performs at least some sound-processing functions and an internal stimulation unit that at least delivers a stimulus to a body part in an auditory pathway of the recipient. The auditory pathway includes a cochlea, an auditory nerve, a region of the recipient's brain, or any other body part that contributes to the perception of sound. In the case of a totally implantable hearing device, the stimulation unit includes both processing and stimulation components, though the external unit may still perform some processing functions when communicatively coupled or connected to the stimulation unit.

SUMMARY

A typical hearing device may include one or more sound processors, generally in the form of application-specific integrated circuits, programmable logic devices, or the like. Hearing devices are generally limited to performing a predefined set of sound processing functions. Adding new sound processing functionality often requires upgrading the sound processors, which may be costly to the recipient.

The present disclosure provides for systems, methods, and devices for overcoming some of the functional limitations of hearing device sound processors. In accordance with the disclosure, a hearing device configured to support remote processing may allow the recipient to utilize sound processing techniques developed by the hearing device's manufacturer as well as third party developers. Further, by allowing for customized sound processing functionality through a media device, the manufacturer can enable its hearing devices to benefit from sound processing techniques suitable for a majority of, if not all, recipients, thereby minimizing the need to produce hearing device models with different sound processing functionalities. Additionally, allowing the recipient to select particular sound processing functions used by the media device, perhaps in the form of downloadable applications provided by the manufacturer of the hearing device or third parties, may provide the recipient with a degree of freedom in tailoring sound processing functionality to meet the recipient's individual preference. Whereas hearing devices are generally preconfigured with a set number of sound processing functions, hearing devices operating in accordance with the present disclosure may allow each recipient to select one or more sound processing functions that might otherwise be unavailable in a stock hearing device. As used herein, the term "media device" refers to a computing device that is separate and distinct from a hearing device that includes one or more microprocessors configurable for processing sounds. Example media devices include a smartphone, a tablet computer, a personal media player, or a laptop computer.

By way of example, a recipient of a hearing device may also have access to a media device that the recipient can connect to the hearing device via a wired connection or a wireless connection. The recipient may interact with the media device to download to the media device a remote sound processing application (an "app") configured to perform one or more sound processing functions. Upon initiation of the remote sound processing application, the media device may send to the hearing device a command to provide the media device with a stream of audio signals, with each audio signal including data indicative of a sound received by one or more microphones (or other audio transducers) of the hearing device. In some examples, the hearing device may stream the audio signals to the media device in response to receiving the command. In other examples, the hearing device may first verify that the media device is authorized to receive and process the audio signals. To this end, the command may include one or more identifiers that identify the media device, the hearing device to which the command is sent, and/or one or more sound processing functions that the media device will perform on the received audio signals. The hearing device may stream to the media device the requested audio signals after verifying that at least one, if not each, identifier included in the command matches an authorized identifier stored in a data storage of the hearing device. Otherwise, the hearing device may not stream the audio signals to the media device. Such verification may prevent unintentional remote processing that could occur when multiple hearing devices are within range of a media device running the remote sound processing application.

The media device, in turn, may apply to each received audio signal one or more sound processing functions, thereby generating a plurality of remotely-processed signals. Such sound processing functions may replace and/or supplement the standard sound processing functions performed by the hearing device. The media device may then send each remotely-processed signal to the hearing device.

The hearing device may thus receive the plurality of remotely-processed audio signals, and the hearing device may generate a plurality of stimulation signals by further processing each remotely-processed audio signal. In this manner, the recipient may use the media device to apply new sound processing functionality on audio signals received at the hearing device without replacing hardware or software components of the hearing device, and without waiting for the manufacture to develop such components. Remotely processing the audio signals may increase the quality of the audio data used to generate the stimulation signals, which may improve the quality of the sound perceived by the recipient.

Accordingly, in one respect, disclosed herein is a method operable by a hearing device to facilitate such functionality. The method includes a hearing device receiving from a media device a command to send to the media device an audio signal, with the audio signal including audio data indicative of a sound received at the hearing device. Responsive to at least the command, the method includes the hearing device sending to the media device the audio signal. The method also includes the hearing device receiving from the media device a remotely-processed signal, with data included in the remotely-processed signals being based on audio data included in the audio signal. Based on at least the remotely-processed signal, the method includes the hearing device generating at least one stimulation signal. Additionally, the method includes the hearing device using the at least one stimulation signal to deliver at least one stimulus to a recipient of the hearing device.

In another respect, a hearing device system is disclosed. The hearing device system includes (1) an audio transducer configured to provide a plurality of audio signals in response to receiving sounds from an acoustic environment; (2) a communication interface configured to communicate with a media device; (3) a stimulation component configured to stimulate a recipient of the hearing device; and (4) one or more processors. The one or more processors are configured to receive from the media device via the communication interface a command to send to the media device the plurality of audio signals. Responsive to the command, the one or more processors are also configured to make a determination of whether to send the plurality of audio signals. Based on the determination, the one or more processors are configured to generate a plurality of stimulation signals. The one or more processors are further configured to send each stimulation signal to the stimulation component, thereby causing the stimulation component to deliver to the recipient one or more stimuli. If the determination is to send the plurality of audio signals, then the one or more processors generate the plurality of stimulation signals by (a) sending to the media device via the transceiver the plurality of audio signals, (b) receiving from the media device via the transceiver a plurality of remotely-processed signals, and (c) processing at least each remotely-processed signal. On the other hand, if the determination is not to send the media device the plurality of requested audio signals, then the one or more processors generate the plurality of stimulation signals by processing the plurality of audio signals.

In yet another respect, a sound processor is disclosed. The sound processor is configured to receive a command to send an audio signal to the media device, with the audio signal including audio data indicative of a sound received at an audio transducer of a hearing device. The sound processor is configured to make a determination, responsive to receiving the command, to send to a media device an audio signal. Here, the audio signal includes audio data indicative of a sound received at an audio transducer of a hearing device. The sound processor further is configured to send, responsive to the determination, to the media device the audio signal responsive. The sound processor is also configured to receive from the media device a remotely-processed signal. Additionally, the sound processor is configured to generate a stimulation signal by processing at least one of the audio signal or the remotely-processed signal. The sound processor is further configured to cause a stimulation component of the hearing device to deliver to a recipient of the hearing device a stimulus, with the stimulus being based on the stimulation signal.

These as well as other aspects and advantages will become apparent to those of ordinary skill in the art by reading the following detailed description, with reference where appropriate to the accompanying drawings. Further, it is understood that this summary is merely an example and is not intended to limit the scope of the invention as claimed.

DETAILED DESCRIPTION

Figure 1:
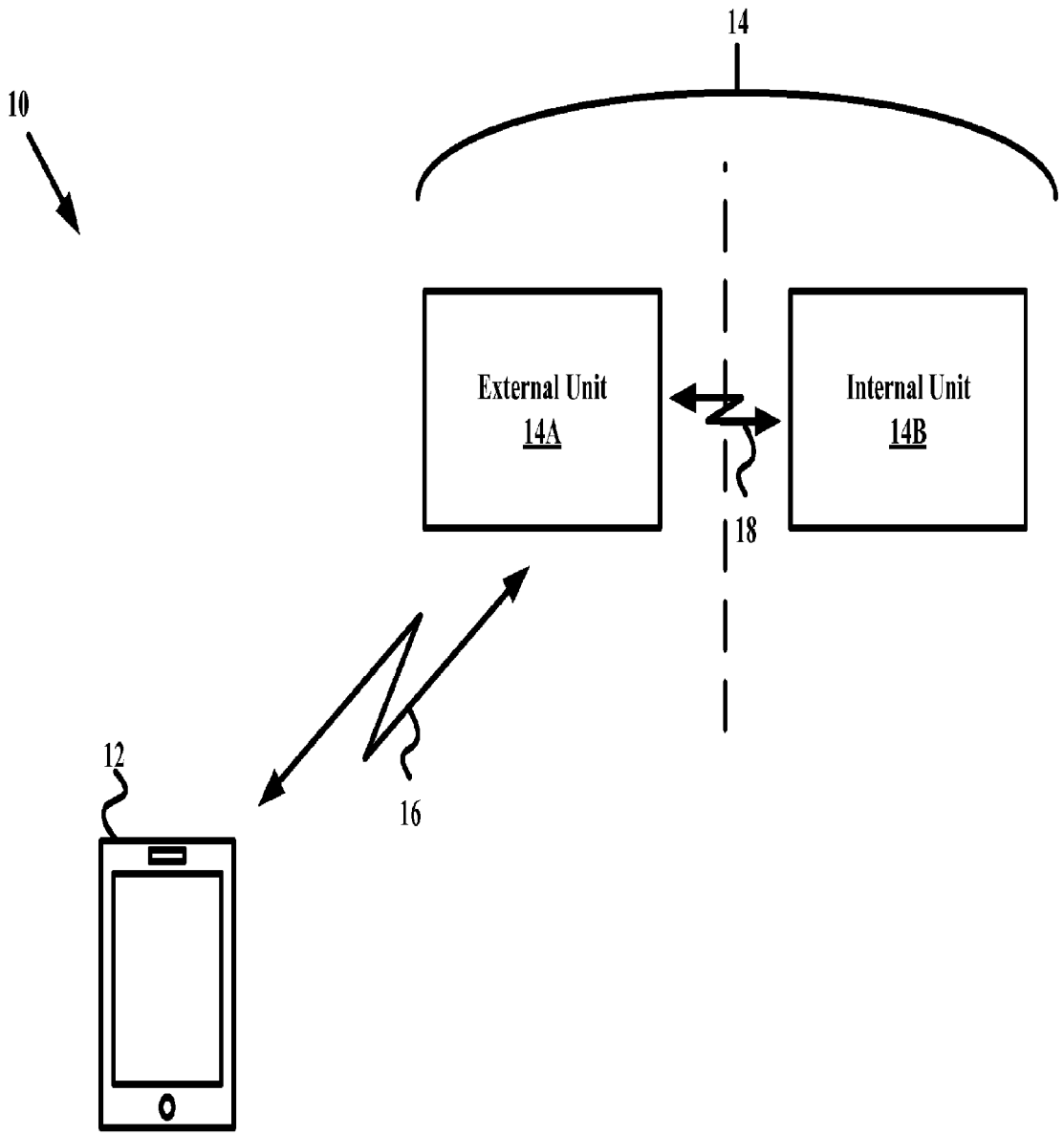
FIG. 1 is a simplified diagram of an example system in which features of the present disclosure can be implemented.

Referring to the drawings, as noted above, FIG. 1 is a simplified illustration of a system 10 in which features of the present disclosure can be implemented. As shown, the system 10 includes a media device 12 and a hearing device 14. As defined above, the media device 12 is separate and distinct from a hearing device (e.g., the media device 12 is not a component of the hearing device 14 and is not a component of another hearing device) and includes a sound processor or a microprocessor with sound processing capabilities. In FIG. 1, the media device 12 is depicted as a smartphone, but the media device could also be a tablet computer, a portable music player, a laptop computer, or even a cloud-based server. The media device 12 may communicate with the hearing device 14 via a wireless link 16, such as a short-range radio frequency link (e.g., a Bluetooth® link or a Wi-Fi link) or the like, or perhaps via a wired connection The hearing device 14 may be an electrical hearing device, an acoustic hearing device, an electromechanical hearing device, or a hybrid combination of two or more hearing devices. The hearing device 14 may include an external unit 14A and an internal unit 14B, which may communicate via an inductive link 18. The external unit 14A may include a battery for providing power to the components of the hearing device 14, one or more microphones (or other audio transducers) for receiving sounds from an acoustic environment, and electronics for processing the received sounds to generate stimulation signals and for communicating with other devices. The internal unit 14B, in turn, may include electronics for generating stimuli based on the stimulation signals and a stimulation component for delivering the stimuli to the recipient. In the case of a cochlear implant, for example, the stimulation component includes an electrode array implanted in one of the recipient's cochleae.

In accordance with the disclosure, the recipient may interact with a remote sound processing application running on the media device 12 to cause the media device 12 to perform one or more sound processing functions on audio signals received by the audio transducers of the hearing device 14. To this end, the recipient of the hearing device 14 (or perhaps another user of the media device 12) may interact with a user interface component of the media device 12 and/or the external unit 14A to initiate a communication session between the external unit 14A and the media device 12. Alternatively, the recipient may configure the external unit 14A to automatically pair itself to the media device 12 (or vice versa).

During the communication session, the recipient may interact with the media device 12 to select one or more sound processing functions for the media device to apply to sounds received at the external unit 14A. Responsive to the selection, the media device 12 may send to the external unit 14A via the link 16 a command that causes the external unit 14A to send one or more streams of audio signals to the media device 12. The command may provide an indication of the requested audio signal(s) to be sent to the media device 12. The requested audio signal may include raw audio signals (e.g., audio signals received from the external unit's 14A microphones) or audio signals on which the external unit 14A has applied one or more sound processing functions. The command may also include an indication of one or more sound processing functions for the external unit 14A to apply after receiving a remotely-processed signal from the media device 12.

Responsive to at least the command, the external unit 14A may stream the requested audio signal(s) to the media device 12, and the media device 12 may apply the selected sound processing functions to each received audio signal, thereby generating one or more remotely-processed signals. The media device 12 may send the remotely-processed signals to the external unit 14A, which the external unit 14A may further process to generate stimulation signals. The external unit 14A may in turn send the stimulation signals to the internal unit 14B, and the internal unit 14B may generate one or more stimuli based on data included in the stimulation signals.

In this manner, the media device 12 may apply more complex sound processing functions than those performed by the external unit 14A. Such remote processing may result in the external unit 14A generating higher-quality stimulation signals that, in turn, allow the recipient to perceive higher-quality sounds (e.g., richer tones or less noise) than the recipient would otherwise perceive with only the external unit 14A processing the received audio signals. Additionally or alternatively, the recipient may use the remote sound processing application to customize one or more characteristics of perceived sounds by causing the media device 12 to perform sound processing functions not performed by the external unit 14A. By way of example, such sound processing functions could include frequency-shifting and/or mixing the received audio signals with a digital sound effect.

To further illustrate the operation of the system 10, FIGS. 2A-2F show flow diagrams of example sound processing functions that the media device 12 and the hearing device 14 may perform when operating in accordance with the disclosure. In each of FIGS. 2A-2E, the external unit 14A may include hardware and/or software for implementing a beamformer module 24, a sensitivity control module 26, an automatic gain control (AGC) module 28, a classifier module 30, a filter bank module 32, an adaptive dynamic range optimization (ADRO) module 34, a sampling and selection module 36, and a loudness mapping module 38. Note that in other examples, the external unit 14A may implement different sound processing functions.

During an example default sound processing operation (e.g., the external unit 14A performs all sound processing functions), a first microphone of the external unit 14A provides a first audio signal 22A and a second audio signal 22B, with each sound signal 22A, 22B being representative of a sound received at the respective microphone. The beamformer module 24 receives and combines the first audio signal 22A and the second audio signal 22B. The sensitivity control module 26 applies a pre-gain to the combined audio signal that accounts for changes in ambient noise included in the combined audio signal, with a value of the pre-gain depending on a noise floor of the combined audio signal. The AGC module 28 then amplifies the combined audio signal to account for dynamic changes in the amplitude of the combined audio signal, such as abrupt changes that may occur when the recipient starts or stops speaking, for instance.

The gain applied by the AGC module 28 may depend in part on a classification of the acoustic environment in which the external unit 14A operates. For instance, the AGC module 28 may apply to the combined audio signal a gain selected from an acoustic environment-specific gain curve. To this end, the classifier module 30 receives the first audio signal 22A and, based on changes in the amplitude in one or more frequency channels over a period of time, determines the acoustic environment. The classifier module 30 then provides to the AGC module 28 an environmental classifier, which the AGC module 28 uses to select an environment-specific gain curve. Note that in other examples, the classifier module 30 may provide the environmental classifier to an additional or different module. For instance, the classifier module 30 may provide the environmental classifier to the beamformer module 24, in which case the beamformer module 24 may select a beamforming algorithm that correlates to the environmental classifier.

The filterbank module 32 next digitizes the combined audio signal and separates the digitized audio signal into a plurality of spectral components, with each spectral component correlating to a frequency channel and perhaps to a particular stimulator (e.g., an electrode on an electrode array of a cochlear implant). For each frequency channel, the filterbank module 32 implements a band-pass filter, such as through the use of a Fast Fourier Transform, and an envelope detector. The ADRO module 34 then applies a frequency-specific gain to each spectral component, with each applied gain depending on the corresponding channel's amplitude history, thereby allowing for controlled changes in the amplitude of each frequency channel.

The sampling and selection module 36 applies a selection scheme to select one or more spectral components from which a stimulation signal 40 will be generated. By way of example, the sampling and selection module 36 may apply an N of M scheme. In this example, the sampling and selection module 36 selects from the M total spectral components the N spectral components having the highest amplitude. For each selected spectral component, the loudness mapping module 38 then determines a recipient-specific amplitude for a stimulus. Further, the loudness mapping module 38 includes in the stimulation signal 40 data indicative of the determined stimulus amplitude for each stimulator (or frequency channel) that correlates to one of the selected spectral components.

Figure 2A:
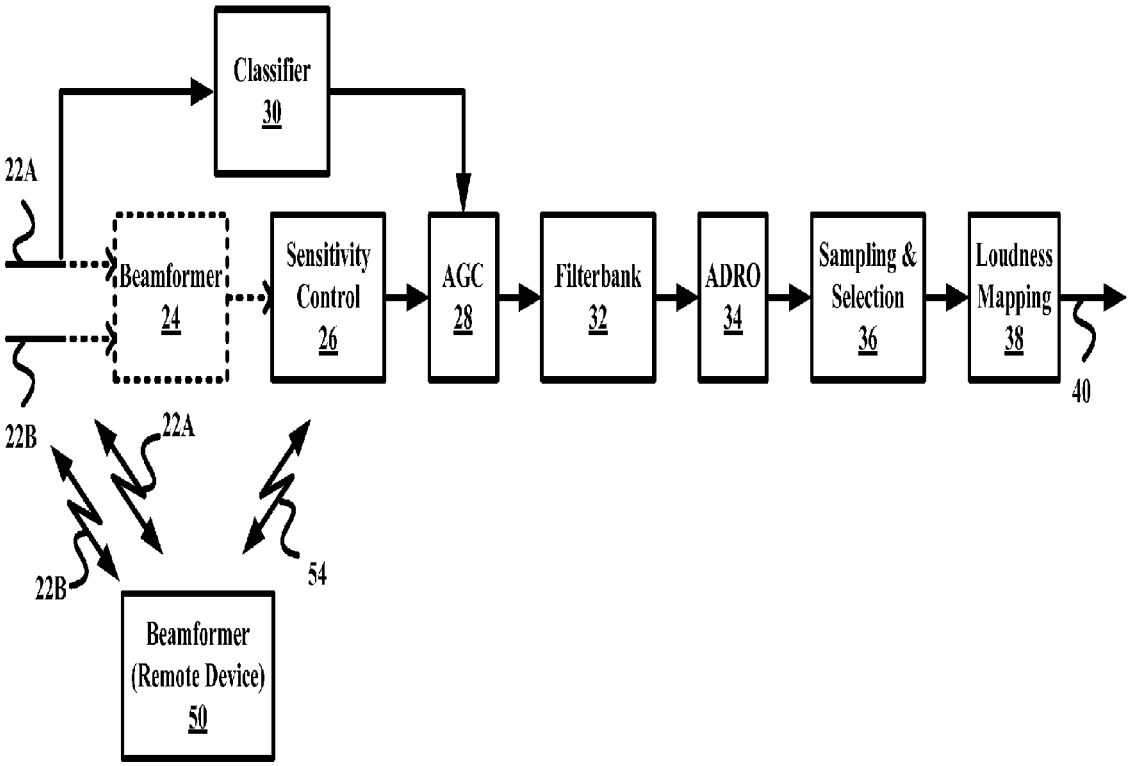
FIGS. 2A, 2B, 2C, 2D, 2E, and 2F are example diagrams depicting sound processing functions performed by hearing devices and media devices.

During a communication session with the media device 12, the external unit 14A may not perform the sound processing functions associated with one or more of these modules. Instead, the media device 12 may perform the omitted sound processing functions, and perhaps other sound processing functions as well. In FIG. 2A, for example, the recipient may interact with the remote sound processing application to select a beamformer operation 50 that the media device 12 applies to the audio signals 22A, 22B, with the beamformer operation 50 being a different and/or more complex beamforming technique than would be performed by the beamformer module 24.

The media device 12 may thus send to the external unit 14A (via the link 16) a command that identifies the first and second audio signal 22A, 22B as the requested audio signals. After the external unit 14A at least receives the command, the external unit 14A may send the first and second audio signals 22A, 22B to the media device 12. The media device 12 may then apply the beamformer operation 50 to the received audio signals 22A, 22B to generate a remotely-processed signal 54. The external unit 14A may in turn receive the remotely-processed signal 54 from the media device 12 and input the remotely-processed signal 54 into the sensitivity control module 26. The external unit 14A may then generate the stimulation signal 40 by applying to the remotely-processed sound signal 54 the functions of the sensitivity control module 26, the AGC module 28, the classifier module 30, the filterbank module 32, the ADRO module 34, the sampling and selection module 36, and the loudness mapping module 38.

Figure 2B:
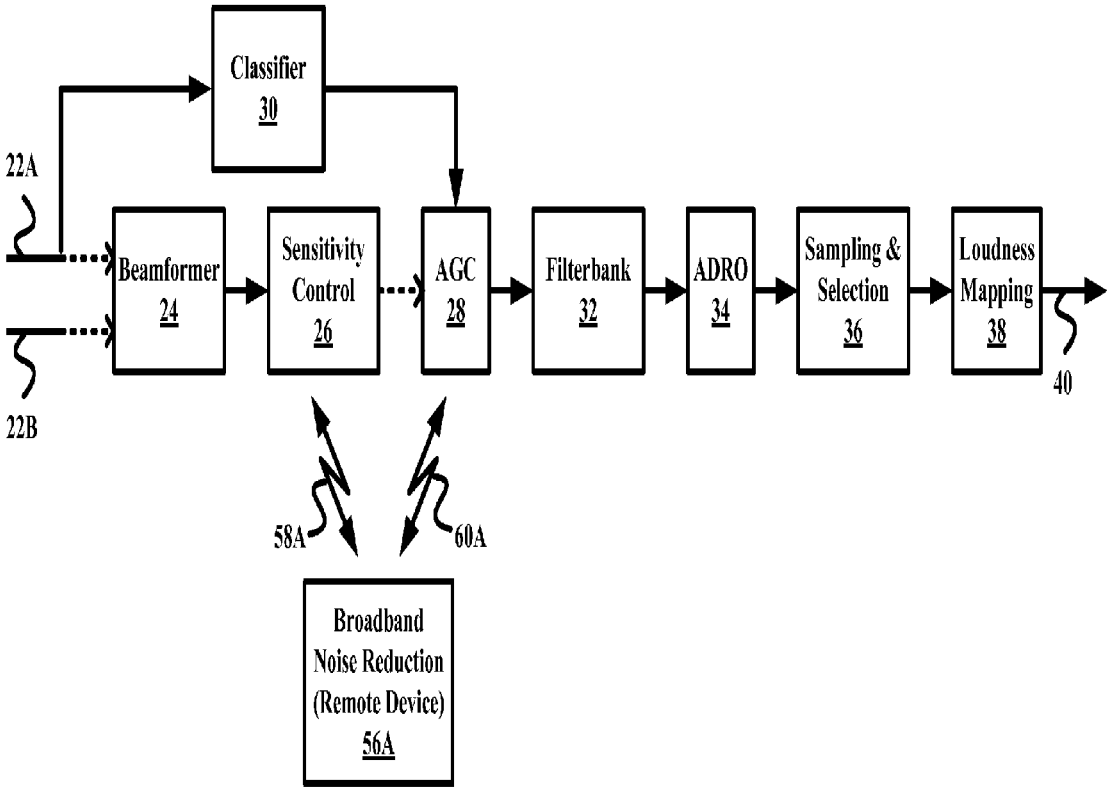
Figure 2C:
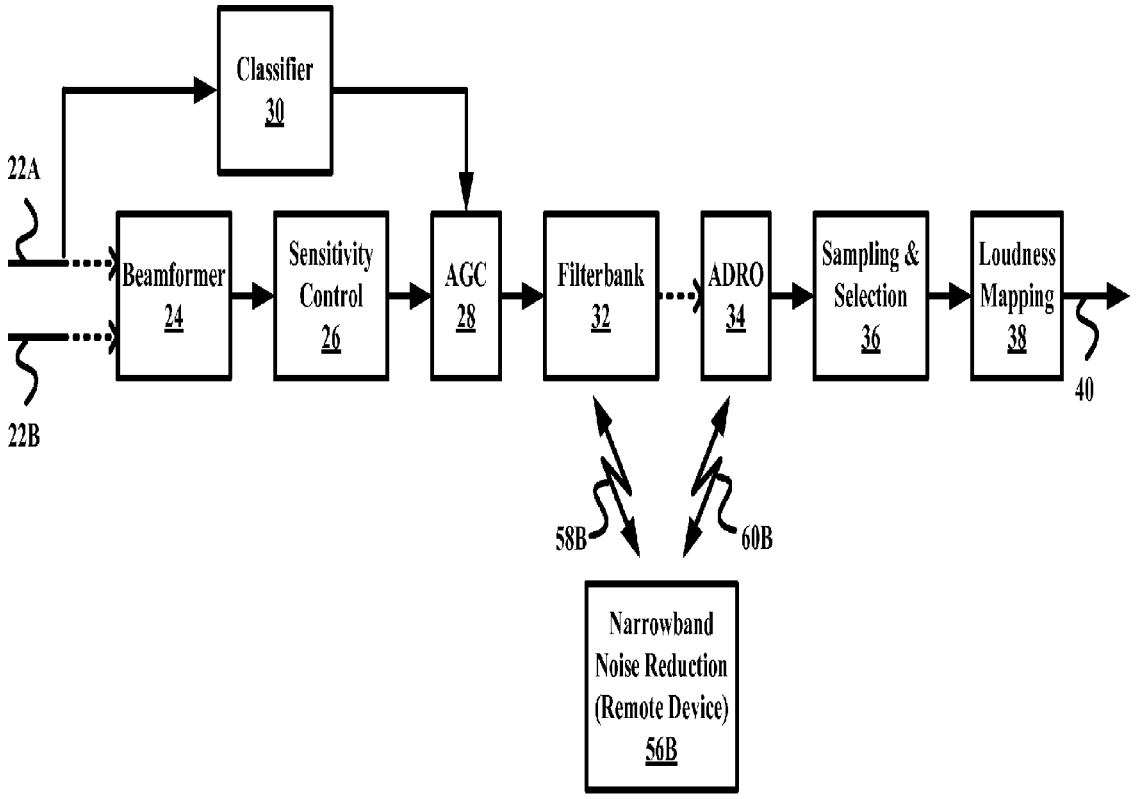

In other examples, the recipient may interact with remote sound processing application to cause the media device 12 to perform a sound processing function that is not included in the default sound processing functions. By way of example, FIGS. 2B and 2C show examples in which the media device 12 applies noise reduction operations. In FIG. 2B, the media device 12 may provide a broadband noise reduction function 56A. Here, the command may identify an output from the sensitivity control module 26 as a requested audio signal 58A. The media device 12 may then apply to each combined audio signal 58A the noise reduction operation 56A, thereby generating a remotely-processed signal 60A. The command may also cause the external unit 14A to apply the remotely-processed signal 60A to the input of the AGC module 28, as opposed to applying the output of the sensitivity control module 26 to the input of the AGC module 28. In this example, the remotely-processed signals 60A may have a lower noise floor than the combined audio signals at the output of the sensitivity control module 26, resulting in higher signal-to-noise ratios at the output of the AGC module 28.

In FIG. 2C, the requested audio signals 58B are the output of the filterbank module 32. In this case, the media device 12 may generate a plurality of remotely-processed sound signals 60B by applying to each requested audio signal 58B a narrowband noise reduction operation 56B. The external unit 14A may receive each remotely-processed signal 60B and input the remotely-processed signal 60B into the ADRO module 34. The resulting signal-to-noise ratio at the output of the ADRO module 34 may be higher than when the ADRO module 34 receives the output of the filterbank module 32, thereby facilitating more finely-tuned dynamic range adjustments in each frequency channel and allowing for clearer audio percepts. Note that the media device 12 could apply to the plurality of audio signals other sound processing functions, such as a frequency shift operation, in lieu of or in addition to the noise reduction operations 56A, 56B.

Figure 2D:
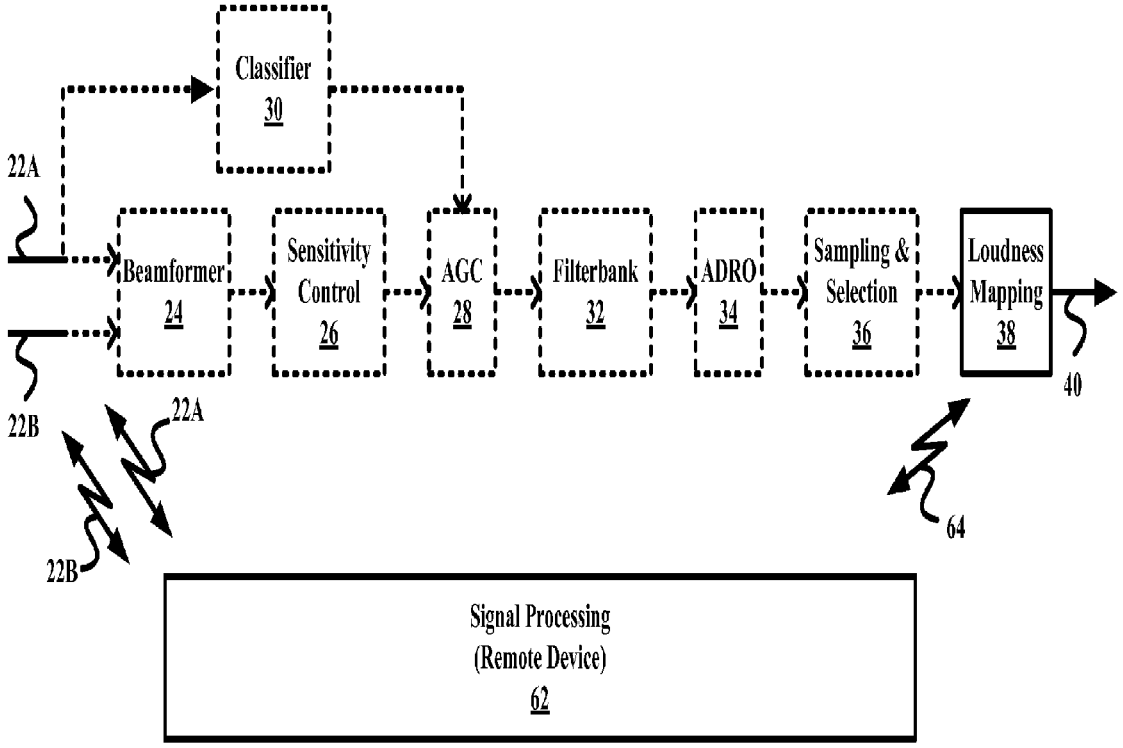

In yet another example, the recipient may interact with the remote sound processing application to cause the media device 12 to perform all signal processing on received audio signals. As shown in FIG. 2D, the media device 12 may receive the audio signals 22A, 22B, and may generate the remotely-processed signals 64 by applying sound processing operations 62 to the audio signals 22A, 22B. The sound processing operations 62 may include some or all of the sound processing functions performed by the modules 24-36, as well as additional sound processing functions. In this manner, the recipient may customize the recipient's personal hearing experience by selecting any number of a plurality of sound processing functions for the media device to apply to the audio signals 22A, 22B. In addition to providing higher-quality and/or customized perception, transferring most of the sound processing functions to the media device 12 may increase the battery life of the external unit 14A.

In the example shown in FIG. 2D, the external device 14A performs the loudness mapping functions 38. This may prevent stimulating the recipient with an improper stimulus amplitude, which could occur if the media device 12 was to use loudness-mapping curves (e.g., loudness-mapping curves for another recipient) when performing functions similar to those of the loudness mapping module 38. In other examples, the remote sound processing application may include safeguards that minimize or prevent the risk of including improper stimulus amplitudes in a stimulation signal, which could allow the media device to generate stimulation signals. In this case, the remotely-processed signal may be the stimulation signal, in which case the command would cause the external unit 14A to send the remotely-processed signal directly to the internal unit 14B.

In some examples, the number of selectable sound processing functions may be limited, as processing delays associated with each sound processing function, as well as delays due to transmissions between the media device 12 and the external unit 14A, may result in perceptible delays in the perceived sound. During a conversation, for instance, processing and/or transmission delays could result in the sounds perceived by the recipient not being synchronized with the speaker's lips. While the remote sound processing application may be configured to avoid this situation by limiting the number of sound processing functions the recipient can select at one time, the media device 12 may also include in the command (or an additional signal sent to the external unit 14A) an indication of the sound processing functions that media device 12 will perform on the requested audio signals. From such an indication, the external unit 14A may determine an expected delay, perhaps by accessing data stored in a data storage that includes a time delay for one or more remote sound processing functions. The external unit 14A may responsively determine that the external delay is threshold high (e.g., greater than an acceptable delay), in which case the external unit 14A may decline to send the plurality of partially-processed signals 52A, 52B to the media device 12.

Figure 2E:
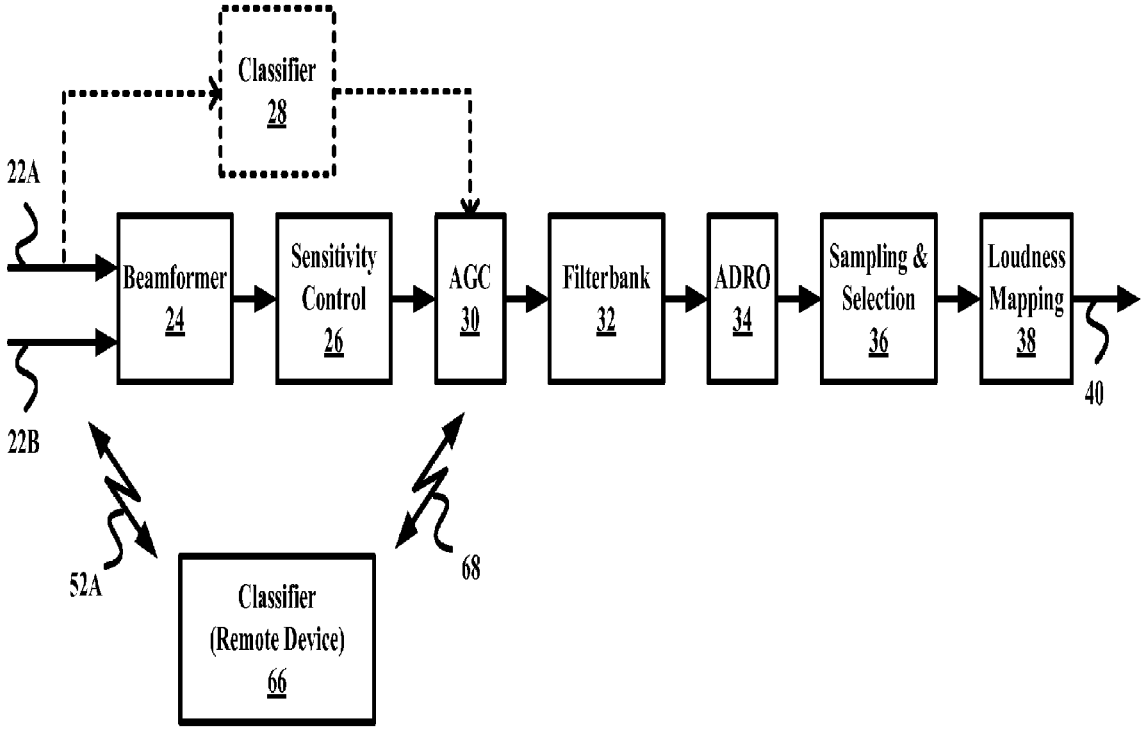

In the examples described with respect to FIGS. 2A-2D, each remotely-processed signal 54, 60A, 60B, and 64 includes audio data. In an alternative example, the remotely-processed signals provided by the media device 12 may include data other than audio data. In FIG. 2E, for instance, the media device 12 may receive from the external unit 14A the first audio signal 22A, which the media device 12 may use to determine the environmental classifier by applying to each first audio signal 52A classifier operation 66. The remotely-processed signal 68 may thus include an environmental classifier. In this example, the command may include an indication that the external unit 14A should use the remotely-processed signal 68 to select a gain curve for use by the AGC module 28. The external unit 14A may then use the selected gain curve when performing the functions of the AGC module 28. The external unit 14A may process the combined audio signal as per the default sound processing operation using the selected gain curve.

Further, the external unit 14A may determine and apply to the combined audio signals a compensation delay. The compensation delay may account for the delays due to the external unit 14A transmitting the audio signal(s) to the remote device 12, the remote device 12 processing the received audio signal(s), and the remote device 12 transmitting the remotely-processed signal to the external unit 14A. In the example depicted in FIG. 2E, for instance, applying the compensation delay to the combined audio signal may ensure that, when processing the combined audio signal, the external unit 14A selects the parameters for the AGC module 32 that correspond to the environmental classifier determined by the remote device 12. Note that the external unit 14A may determine a compensation delay in other situations and examples as well.

Figure 2F:
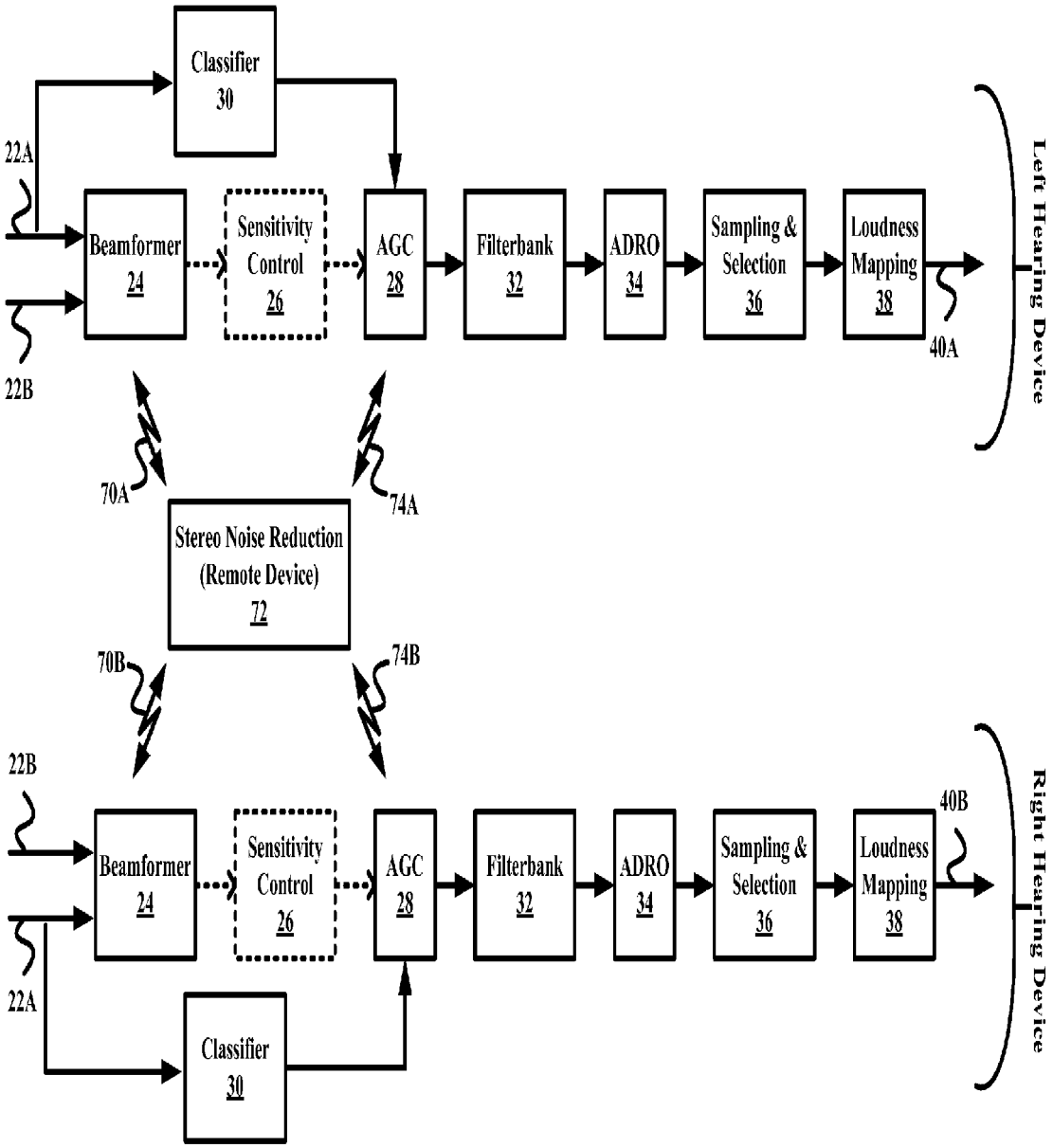

Additionally, the system 10 could be adapted for use in a bilateral hearing prosthesis system. In this case, the recipient may utilize two hearing devices—a right hearing device and a left hearing device—to perceive sounds. As shown in FIG. 2F, the recipient may wear a left hearing device and a right hearing device, each of which is functionally identical to the hearing device 14A. In this example, the recipient may interact with the remote sound processing application to cause a media device to apply to received audio streams stereo noise reduction operations 72. Here, the left hearing device may send to the media device a first stream of audio signals 70A in response to receiving a first command, while the right hearing device may send to the media device a second stream of audio signals 70B in response to receiving a second command. In this example, each requested audio signal 70A, 70B may be the output of the respective hearing device's beamformer module 24.

The media device may apply to each audio signal 70A, 70B the stereo noise reduction operations 72, thereby generating a remotely-processed signal 74A for the left hearing device and a remotely-processed signal 74B for the right hearing device. Each hearing device may then apply the received remotely-processed signals 74A, 74B to the respective AGC module 28 based on indications included in the respective commands. The resulting outputs of the AGC modules 28 may have better signal-to-noise ratios than as compared to the signal-to-noise ratios using the default sound processing operations, which may in turn provide the recipient with clearer audio precepts.

In the example described with respect to FIG. 2F, the remotely-processed signals 74A, 74B may include different information. For instance, the remotely-processed signal 74A for the left hearing device may be a stereo noise-reduced version of the audio signal 70A provided by the left hearing device, while the remotely-processed signal 74A for the right hearing device may be a stereo noise-reduced version of the audio signal 70B provided by the right hearing device. In other examples, the remotely-processed signals sent to bilateral hearing devices may be the same. In an example where the remote device 12 determines an environmental classifier, for instance, the remote device may send the same environmental classifier to each hearing device.

In the previous examples, the command includes data indicative of the identity of the requested audio signal(s) (e.g., which module's input/output to send to the media device). In other examples, the external unit 14A may be configured to send to the media device 12 the output of a predetermined module and/or to receive the remotely-processed signal as an input to a predetermined module. In another example, the remote device 12 may include in the unprompted command data indicative of one or more sound processing functions that the remote device 12 will apply to the received audio signals. In this case, the external unit 14A may, in response to receiving the unprompted command, identify one or more remote sound processing functions in the unprompted command and, based on the identified remote sound processing function(s), determine which sound processing functions to apply to the audio signals prior to sending the audio signals to the remote device. Additionally or alternatively, the external unit 14A may determine, again based on the identified remote sound processing function(s), which sound processing function(s) to apply to the remotely-processed signals.

Figure 3A:
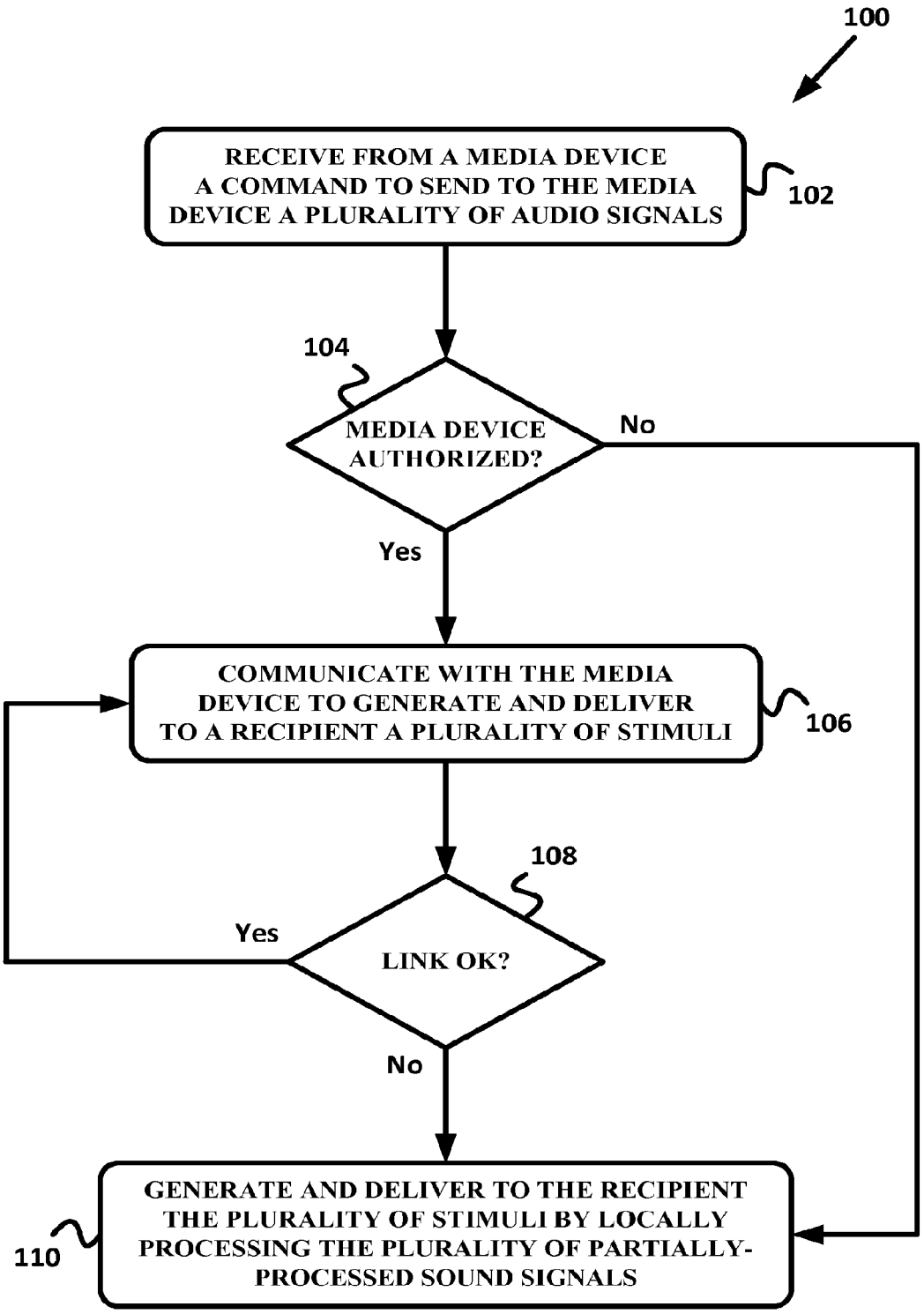
FIGS. 3A and 3B are flow charts depicting functions that can be carried out in accordance with the present disclosure.

Turning now to FIG. 3A, a flow chart of a method 100 is shown. The method 100 includes example steps that a hearing device may perform to generate and deliver stimuli when some sound processing functions are performed by an external media device.

Beginning at block 102, the hearing device receives from the media device a command to send to the media device a plurality of audio signals. Next at block 104, the hearing device determines whether the media device is authorized to receive the plurality of audio signals. As discussed above, verifying that the media device is authorized to receive the plurality of audio signals before transmitting the plurality of audio signals may ensure that the hearing device does not unintentionally transfer sound processing functions to the media device, which could happen if two hearing devices receive the command.

By way of example, the command may include a media device identifier unique to the media device. The hearing device, in turn, may have access to one or more authorized device identifiers, with each authorized device identifier correlating to a media device authorized to receive audio signals from the hearing device. If the hearing device determines that the device identifier is one of the authorized device identifiers, then the hearing device may responsively determine that the media device is authorized to receive the plurality of audio signals. But if the hearing device determines that the device identifier is not one of the one or more authorized device identifiers, then the hearing device may determine that the media device is not authorized to receive the plurality of audio signals.

In another example, the command may include a target identifier, which may correlate to the hearing device from which the media device intends to receive the plurality of partially-processed signals. Here, the hearing device may have access to a hearing device identifier that is unique (or is otherwise assigned) to the hearing device to distinguish the hearing device from other hearing devices. As in the example with the device identifier, the hearing device may determine that the media device is authorized to receive the plurality of audio signals when the target identifier matches the hearing device identifier, but not authorized when the target identifier does not match the hearing device identifier.

Additionally, the determination may include determining whether the media device is authorized to apply one or more sound processing functions to each audio signal when generating each remotely-processed signal. For example, the command may include one or more function identifiers, each of which indicates one or more sound processing functions that the media device will apply to the received audio signals. The hearing device may have access to one or more authorized function identifiers, and the hearing device may determine whether the function identifier included in the command matches one of the one or more authorized function identifiers. For example, the recipient or another user (e.g., a parent in the case of juvenile recipient) may interact with the remote sound processing application (or perhaps another application) to upload the one or more authorized function identifiers to the external unit 14A. In this manner, the recipient or other user may limit the sound processing functions performed by the media device to a certain set of sound processing functions.

Figure 3B:
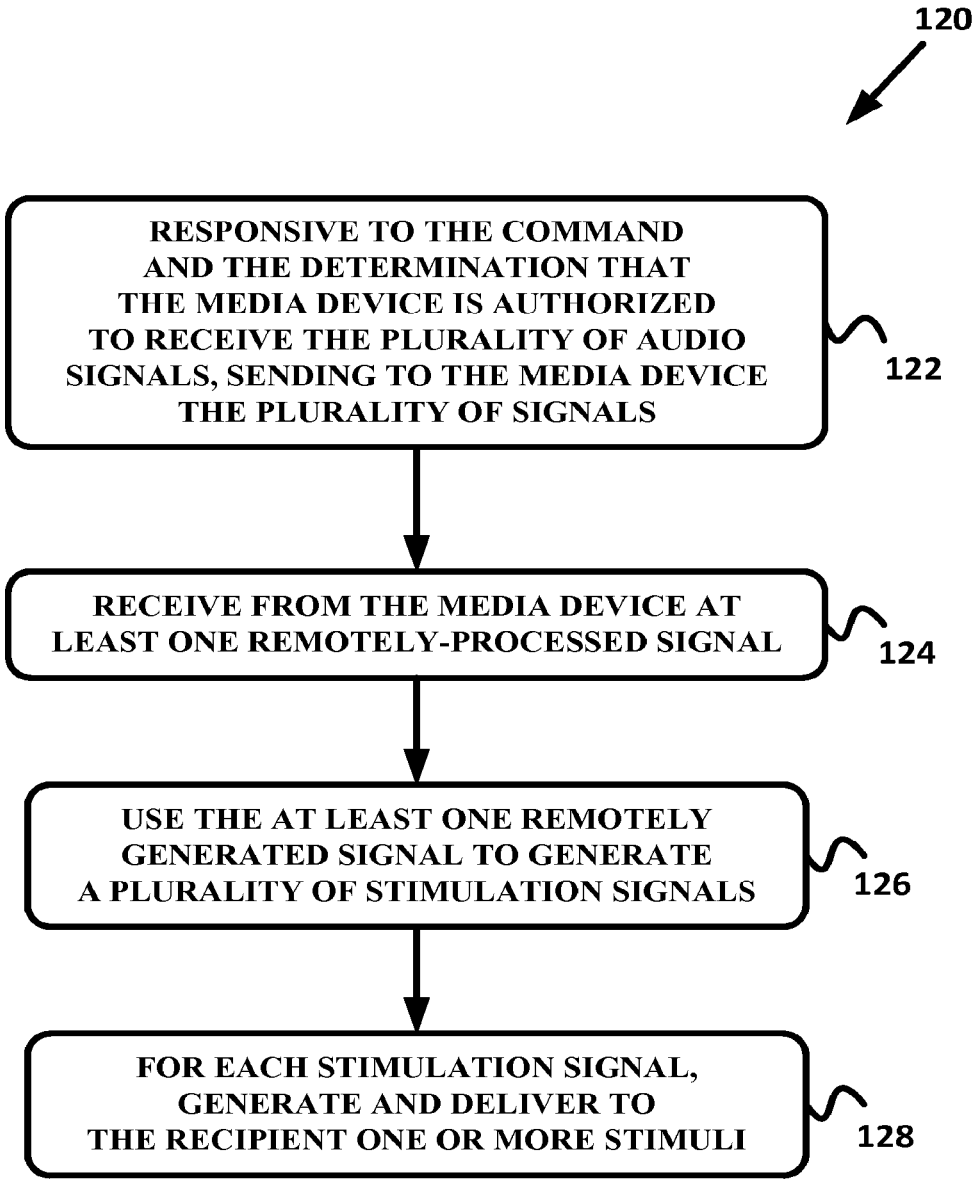

If the hearing device determines that the media device is not authorized to receive the plurality of audio signals, the hearing device proceeds to block 110. On the other hand, if the hearing device determines that the media device is authorized to receive the plurality of audio signals, then the hearing device communicates with the media device to generate and deliver to a recipient a plurality of stimuli, at block 106. FIG. 3B is a flow chart of a method 120, which shows example steps that a hearing device may perform when executing the steps of block 106 of the method 100.

The method 120 begins at block 122 with the hearing device, responsive to the command and the determination that the media device is authorized to receive the plurality of audio signals, sending to the media device the plurality of audio signals. In line with the above discussion, the hearing device may apply one or more sound processing functions to each of the plurality of audio signals. To this end, the hearing device may determine which sound processing function(s) to apply to each audio signal based on data included in the unprompted command, with such data (a) identifying the request audio signals (e.g., the output of one of the modules described with respect to FIGS. 2A-2F) or (b) being indicative of functions that the remote device will perform on the remotely processed signals. Alternatively, the hearing device could be preconfigured to apply a particular set of sound processing functions to the audio signals before sending the audio signals to the remote device.

Next at block 124, the hearing device may receive from the media device at least one remotely-processed signal, and the hearing device may use the at least one remotely-processed signal to generate a plurality of stimulation signals, at block 126. As discussed above, remotely-processed signal may include audio data, in which case the hearing device generates the stimulation signals based on the audio data included in the remotely-processed signals. On the other hand, the remotely-processed signal may include other data, such as an environmental classifier, that the hearing device may use to select a sound processing parameter used when processing the audio signals to generate the stimulation signals. In the event the remotely processed signals include audio data, the hearing device may generate each stimulation signal by (a) applying to each remotely processed signal a predetermined set of one or more sound processing functions, (b) identifying from the data in the unprompted command the module into which the remotely-processed signal should be input, or (c) determining one or more sound processing functions to apply to the remotely-processed signal based on data in the unprompted command that is indicative of one or more remote sound processing functions.

For each stimulation signal, the hearing device generates and delivers to the recipient one or more stimuli, at block 128. The sounds perceived by the recipient as a result of the recipient receiving such stimuli may provide the recipient a better and/or customized listening experience that the recipient might not experience without the remote processing performed by the media device.

Returning to FIG. 3A, the hearing device may determine whether the link is satisfactory, at block 108. By way of example, the hearing device may determine whether the link is satisfactory by determining whether the error rate for transmissions between the media device and the hearing device is threshold high and/or whether a time between receptions of remotely-processed signals is threshold high. A threshold high error rate and/or a threshold high time between receptions of the remotely-processed signal may indicate that the hearing device is not receiving sufficient data from the media device to generate stimulation signals, which could lead to reduced sound perception by the recipient. In either scenario, the hearing device may determine that the link is not satisfactory, at which point the hearing device proceeds to block 112. Otherwise, the hearing device continues performing the steps of blocks 106 and 108 until the link is not satisfactory.

If the hearing device determines that the media device is not authorized to receive the audio signals, or if the hearing device determines that the link between the hearing device and the media device is not satisfactory, then the hearing device generates and delivers to the recipient the plurality of stimuli by locally processing the plurality of audio signals, at block 112. In this manner, the hearing device may operate in a default sound processing mode, thereby allowing the recipient to continue to perceive sounds when the media device is out of range of the hearing device, or when the recipient terminates the communication session (e.g., closes the sound processing application on the media device or terminates the communication session between the media device and hearing device).

Figure 4:
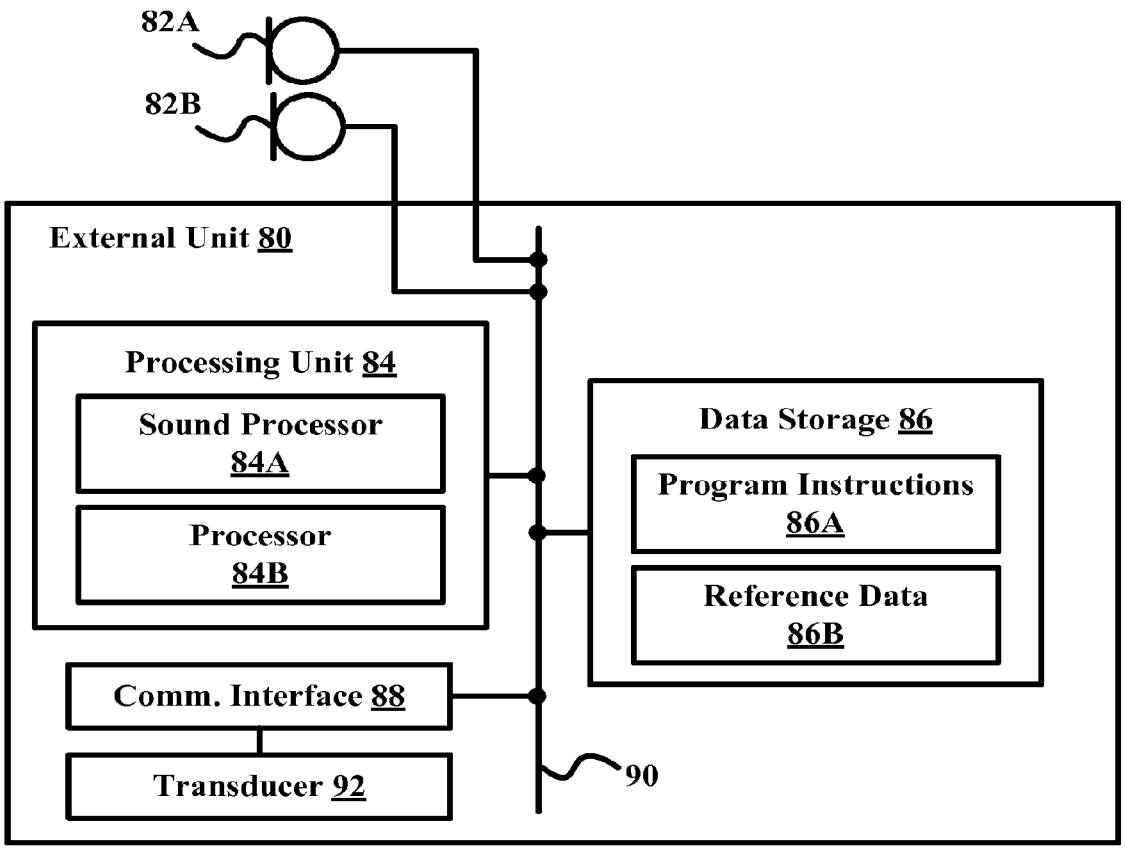
FIG. 4 is a simplified block diagram depicting components of an example hearing device.

Finally, FIG. 4 is a block diagram of example components of an external unit 80 of a hearing device. The external unit 80, which is one example of the external unit 14A depicted in FIG. 1, includes microphones (or other audio transducers) 82A and 82B, a processing unit 84, data storage 86, and a communication interface 88, which are communicatively linked together by a system bus, network, or other connection mechanism 90. The external unit 80 also includes a rechargeable battery (not shown) that provides power to the components of the external unit 14A as well as the internal unit of the hearing device, and a transducer 92, such as an inductive coil, that is electrically connected to the communication interface 88 to facilitate transmissions between the external unit and the internal unit, including transmission of a power signal to the internal unit.

In an example arrangement, the components are included in a single physical housing. In alternative arrangements, the components could be provided in multiple physical housings. For example, a behind-the-ear housing could include the microphones 82A and 82B, the processing unit 84, the data storage 86, and the communication interface 88, while a separate housing connected to the behind-the-ear housing, perhaps by a cable, could include the transducer 92.

Alternatively, the external unit 80 could be integrated with the components of the internal unit, such as in the case of a totally implantable hearing device. In this example, the components of the external unit 80, with the exception of the microphones 82A and 82B, may be included in single hermetically sealed case that is implanted in the recipient's body. Other arrangements are possible as well.

In the arrangement as shown, the microphones 82A and 82B may be positioned to receive sounds, such as audio coming from an acoustic environment, and to provide a corresponding signal (e.g., electrical or optical, possibly sampled) to the processing unit 82. For instance, the microphones 82A and 82B may be positioned on an exposed surface of the housing of the external unit 80. Further, the microphones 82A and 82B may comprise additional microphones and/or other audio transducers, which could also be positioned on an exposed surface of the housing of the external unit 80.

The processing unit 84 may then comprise one or more digital signal processors (e.g., application-specific integrated circuits, programmable logic devices, etc.), as well as analog-to-digital converters. As shown, at least one such processor functions as a sound processor 84A, to process received sounds so as to enable generation of corresponding stimulation signals as discussed above. Further, another such processor 84B could be configured to coordinate the transmission of audio signals to and the reception of remotely-processed signals from a media device, such as the media device 12 depicted in FIG. 1. Alternatively, all processing functions could be carried out by the sound processor 84A itself.

The data storage 86 may then comprise one or more volatile and/or non-volatile storage components, such as magnetic, optical, or flash storage, and may be integrated in whole or in part with processing unit 84. As shown, the data storage 86 may hold program instructions 86A executable by the processing unit 84 to carry out various hearing device functions described herein, as well as reference data 86B that the processing unit 84 may reference as a basis to carry out various such functions.

By way of example, the program instructions 86A may be executable by the processing unit 84 to facilitate processing sounds received via the microphones 82A and 82B and to generate stimulation signals. The program instructions 86A may also include instructions executable by the processing unit 84 to perform the steps of one or more blocks of the methods 100 and 120. The reference data 86B in turn may include data accessible by the processing unit 84 when performing such steps, such as data indicative of one or more authorized device identifiers, a hearing device identifier, and/or one or more authorized function identifiers.

Finally, the communication interface 88 may include one or more transceivers configured for communications with the media device. By way of example, the communication interface 88 may include an antenna and a transceiver configured for wireless, such as a transceiver configured for short-range radio-frequency communications. Additionally or alternatively, the communication interface 88 may include a port for accepting a cable, thereby allowing for wired communications between the external device 80 and the media device. The communication interface 88 may also include a transceiver for coordinating communications with the internal component of the hearing device.

While various aspects and embodiments have been disclosed herein, other aspects and embodiments will be apparent to those skilled in the art. The various aspects and embodiments disclosed herein are for purposes of illustration and are not intended to be limiting, with the scope being indicated by the following claims.

What is claimed is:

1. A method comprising:

a hearing device receiving from a media device a command to send to the media device an audio signal, wherein the audio signal includes audio data indicative of a sound received at the hearing device;

responsive to at least the command, the hearing device sending to the media device the audio signal;

the hearing device receiving from the media device at least one remotely-processed signal, wherein data included in the remotely-processed signals is based on the audio signal;

the hearing device generating a stimulation signal by processing at least the remotely-processed signal; and the hearing device using the stimulation signal to generate and deliver at least one stimulus to a recipient of the hearing device, wherein the at least one remotely-processed signal comprises information indicative of an environmental classifier, and wherein the hearing device generating the at least one stimulation signal comprises the hearing device selecting, based on the environment classifier, a sound processing parameter and using the selected sound processing parameter to perform one or more sound processing functions on the audio signals.

2. The method of claim 1, wherein the method further comprises the hearing device making a determination that the media device is authorized to receive the audio signal, and wherein the hearing device sending the audio signal is responsive to at least the command and the determination.

3. The method of claim 2, wherein the command includes information indicative of an identifier, and wherein the hearing device making the determination comprises the hearing device determining that the identifier matches one of one or more authorized identifiers.

4. The method of claim 1, wherein the remotely-processed signal includes audio data, and wherein the hearing device generating the stimulation signal comprises the hearing device performing on the remotely-processed signal at least one sound processing function.

5. The method of claim 1, further comprising the hearing device performing on the audio signal at least one sound processing function before sending the audio signal to the media device.

6. The method of claim 5, wherein the command includes data indicative of a requested audio signal, and wherein the audio signal matches the requested audio signal as a result of the hearing device performing the at least one sound processing function on the audio signal.

7. A hearing device system comprising:

an audio transducer configured to provide a plurality of audio signals in response to receiving sounds from an acoustic environment;

a communication interface configured to communicate with a media device;

a stimulation component configured to stimulate a recipient of the hearing device; and one or more processors configured to:

(i) receive from the media device via the communication interface a request for the plurality of audio signals;

(ii) make a determination of whether to provide the media device with the plurality of audio signals;

(iii) generate, based on the determination, a first plurality of stimulation signals; and (iv) send to the stimulation component each stimulation signal, thereby causing the stimulation component to deliver to the recipient a plurality of stimuli, wherein: if the determination is to send the plurality of audio signals, the one or more processors generate the first plurality of stimulation signals by (a) sending to the media device via the communication interface the plurality of audio signals, (b) receiving from the media device via the communication interface a plurality of remotely-processed signals, and (c) processing at least each remotely-processed signal, and if the determination is to not provide the media device with the plurality of audio signals, the one or more processors generate the first plurality of stimulation signals by processing the plurality of audio signals.

8. The hearing device system of claim 7, wherein one or more of the plurality of remotely-processed signals includes audio data.

9. The hearing device system of claim 7, wherein one or more of the plurality of remotely-processed signals includes data indicative of an acoustic environment in which the hearing device system is operating.

10. The hearing device system of claim 7, wherein the command includes data indicative of a media device identifier, and wherein, to make the determination, the one or more processors are configured to determine whether the media device identifier matches an authorized device identifier.

11. The hearing device system of claim 7, wherein the command includes data indicative of a function identifier, and wherein, to make the determination, the one or more processors are configured to determine whether the media device identifier matches an authorized function identifier.

12. The hearing device system of claim 7, wherein the one or more processors are further configured to determine that a status of a link between the media device and the hearing device system is unsatisfactory, and, responsive to determining that the status of the link is unsatisfactory, (a) process the plurality of audio signals to provide the plurality of locally-processed audio signals, and (b) use the plurality of locally-processed audio signals to cause the stimulation component to deliver a second plurality of stimuli to the recipient.

13. The hearing device system of claim 12, wherein the status of the link is unsatisfactory when an error rate for the plurality of remotely-processed signals is threshold high.

14. A sound processor configured to:

receive from a media device a command to send an audio signal to the media device, wherein the audio signal includes audio data indicative of a sound received at an audio transducer of a hearing device;

responsive to receiving the command, make a determination to send the audio signal to the media device;

send, responsive to the determination, the audio signal to the media device;

receive from the media device a remotely-processed signal;

process at least one of the audio signal or the remotely-processed signal to generate a stimulation signal; and cause a stimulation component of the hearing device to deliver to a recipient of the hearing device a stimulus, wherein the stimulus is based on the stimulation signal, wherein the remotely-processed sound signal includes data usable by the sound processor to select a sound processing parameter, and wherein the sound processor is configured to process the remotely-processed signal and the audio signal to generate the stimulation signal such that the stimulation signal is based on the audio data included in the audio signal.

15. The sound processor of claim 14, wherein, to make the determination, the sound processor is configured to determine an identifier included in the command matches a corresponding identifier stored in a data storage accessible by the sound processor.

16. The sound processor of claim 14, wherein the remotely-processed signal includes audio data, and wherein the sound processor is configured to process the remotely-processed signal to generate the stimulation signal such that the stimulation signal is based on the audio data included in the remotely-processed signal.

17. The sound processor of claim 14, wherein the sound processor is further configured to process a signal received from the media device, wherein the signal from the media device includes data indicative of one or more sound processing functions that the sound processor applies to the audio signal before sending the audio signal to the media device and one or more sound processing functions applied by the sound processor to the remotely-processed signal to generate the stimulation signal.

* * * * *